United States Patent [19]

Bau et al.

[11] 4,056,278

[45] Nov. 1, 1977

[54] SCOOP DEVICE

[76] Inventors: Marcel Bau, 89 Van Ness Court; Larry D. Hinkes, 45 Van Ness Court, both of Maplewood, N.J. 07040; James Cosgrave, 57 Norwood St., Newark, N.J. 07106

[21] Appl. No.: 701,615

[22] Filed: July 1, 1976

Related U.S. Application Data

[63] Continuation-in-part of Ser. No. 634,821, Nov. 24, 1975.

[51] Int. Cl.[2] ..... A47F 13/06

[52] U.S. Cl. ..... 294/19 R; 294/1 R

[58] Field of Search ..... 294/1 R, 19 A, 19 R, 294/50.8, 50.9, 55, 115; 15/257.1, 257.6; 119/1 R

[56] References Cited

U.S. PATENT DOCUMENTS

| | | | |
|---|---|---|---|
| 3,733,098 | 5/1973 | Tobias | 294/19 R |
| 3,819,220 | 6/1974 | Bredt | 294/19 R |
| 3,912,316 | 10/1975 | Veech | 294/19 R |
| 3,922,027 | 11/1974 | Nesselt | 294/19 A |

*Primary Examiner*—James B. Marbert

*Attorney, Agent, or Firm*—Mel K. Silverman; David A. Jackson

[57] ABSTRACT

The present invention relates to a device for retrieving waste deposits and, more particularly, animal excrement and the like. The device includes an outer tubular shaft having a handle portion formed in the shape of the handle of a walking cane. An inner shaft is concentrically disposed within said outer shaft and is moveable longitudinally with respect thereto. Such longitudinal movement of the inner shaft causes a tension spring to bear against a normally-open hinge which, in the absence of circumferential force thereabout, will exhibit its normally-open position. Longitudinal movement of the inner shaft away from the handle will cause said tension spring to bear against the hinge thus permitting said hinge to open selectably as may be desired. After opening, a throwaway box is attached to the fingers of the hinge and, through an upper movement of the inner shaft, the retrieval of an animal deposit is achieved. Through further selectable movement of the inner shaft, the throwaway box is pulled away and ultimately detached from the device in order to permit it to be easily dropped into a waste disposal area.

5 Claims, 6 Drawing Figures

SCOOP DEVICE

REFERENCE TO RELATED APPLICATION

The present application is a continuation-in-part of Ser. No. 634,821 filed Nov. 24, 1975, entitled DEVICE FOR RETRIEVING ANIMAL WASTE.

BACKGROUND OF THE INVENTION

The present invention relates generally to devices for the retrieval of animal waste deposits and, more particularly, to a device which is portable and suitable to ease of use through simple hand manipulation. Further, the invention relates to a device which is also usable as a walking cane.

As is well recognized, the population of domesticated pets such as dogs and cats is ever increasing and particularly so in urban areas. Accordingly, the effective retrieval of animal waste deposits has, due to possible risk to public health created by resultant unsanitary conditons as well as general inconvenience to the public, become a matter of considerable official concern. In many instances, localities and municipalities have enacted regulations and ordinances restricting areas permitted for the walking of animals. However, as is generally appreciated, it is frequently impractical to comply with such regulations despite the fact that the dog may be leashed and under control at all times.

In the past, it has been necessary to resort to rather cumbersome means and methods for retrieving waste deposits in a sanitary manner which nonetheless would be unoffensive to the pet owner. Typically, prior art devices for such purposes have included a container for retaining the deposits as well as a separate instrument or tool of some kind for guiding the deposits into the container. Such devices are often bulky and awkward, thus making transport and handling of the deposits quite difficult. Moreover, repetitive use of such devices necessarily entails a difficult cleaning problem and, accordingly, devices of this type have been objectionable from both an aesthetic and functional standpoint.

Accordingly, the present invention is intended as a solution to the above problem.

SUMMARY OF THE INVENTION

The present invention relates to a device for the retrieval of animal waste deposits. Said device includes a first tubular shaft having a handle portion formed in the shape of the handle of a walking cane. An inner shaft is concentrically disposed within said first shaft and is moveable longitudinally with respect thereto. Longitudinal movement of the inner shaft causes a tension spring to bear against a normally-open hinge which, in the absence of circumferential pressure thereabout, will pop into an open position. After opening, a throwaway box is attached to the fingers of said hinges and, through movement of the inner shaft, a retrieval of the animal waste deposit is achieved. Through further selectable movement of the inner shaft, the throwaway box is closed and is ultimately detached from the present device in order to permit it to be easily dropped into a waste area.

A primary object of the present invention is to provide a device for the retrieval, transport and disposal of animal waste wherein the disadvantages of prior art devices are eliminated, or at least mitigated to a substantial extent.

A further object of the invention is to provide such a device adapted for hand-transport in a convenient manner, such a device being streamlined and having a lightweight construction.

A still further object of the invention is to provide a device wherein the unsanitary aspects normally incident to the retrieval and disposal of animal waste are substantially alleviated.

Another object of the invention is to provide a device capable of efficient use with a minimum of physical exertion, e.g., bending, stooping and the like, required on the part of the user.

Yet another object of the invention is to provide such a device enabling retrieval, transport and disposal of animal deposits, such a device having a replacable pick-up box conducive to repetitive and sanitary use.

A further object of the invention is to provide such a device having an arrangement of parts conducive to simple and inexpensive manufacture.

Other objects and advantages of the invention will become apparent from the following discussion with reference to the accompanying drawings.

DETAILED DESCRIPTION OF THE INVENTION

Figure 1:
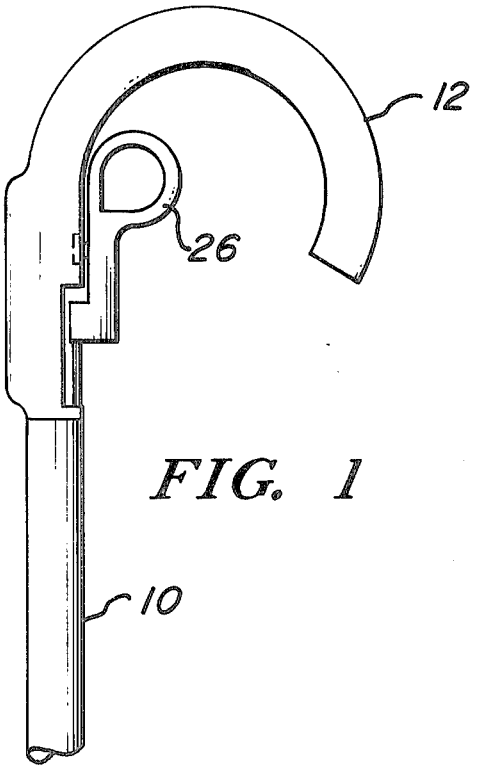
FIG. 1 is a side plan, partial schematic view of the present device showing the fingers of the hinge in their retracted position such as to permit the use of the present device as a walking cane.

The invention is described by reference to the accompanying drawings wherein like reference numerals refer to similar parts throughout the several views and wherein reference numeral 10 generally designates a waste deposit retrieval device having a handle portion 12, formed in the shape of the handle of a walking cane, and a distal end portion 14, said portions being connected by an outer shaft 16 and a concentrically disposed inner shaft 18, said shaft being longitudinally moveable with respect to said outer shaft 16.

Figure 4:
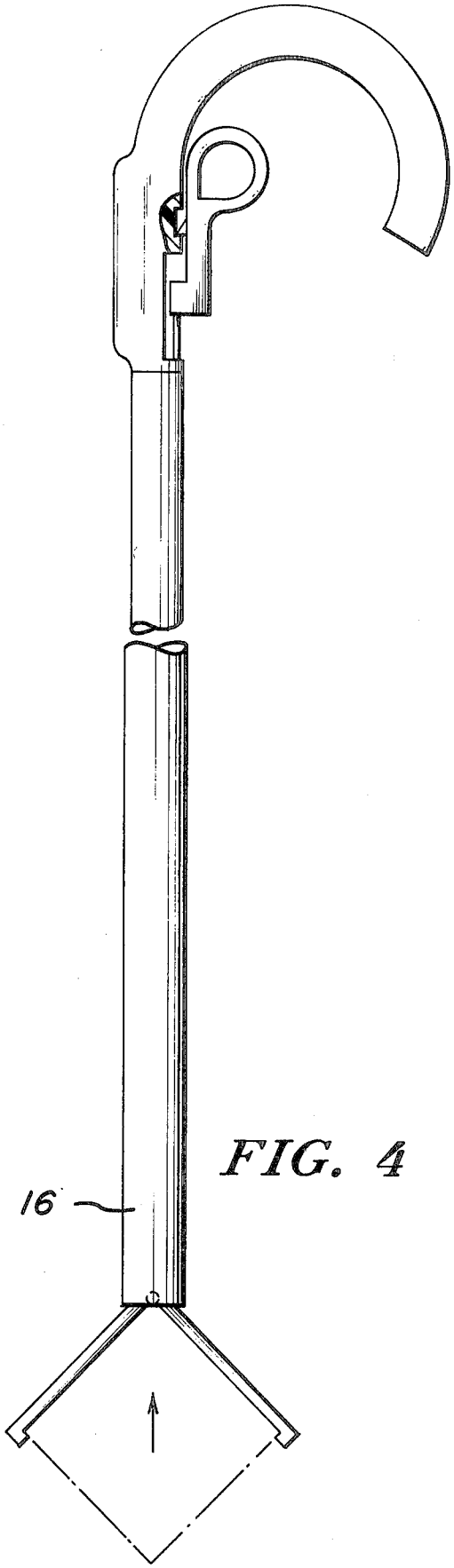
FIG. 4 is a perspective schematic view showing the retraction of the ball element and axial member in order to effectuate a closure of the box as well as the ultimate disconnection of said ball element and axial member from said box.
Figure 5:
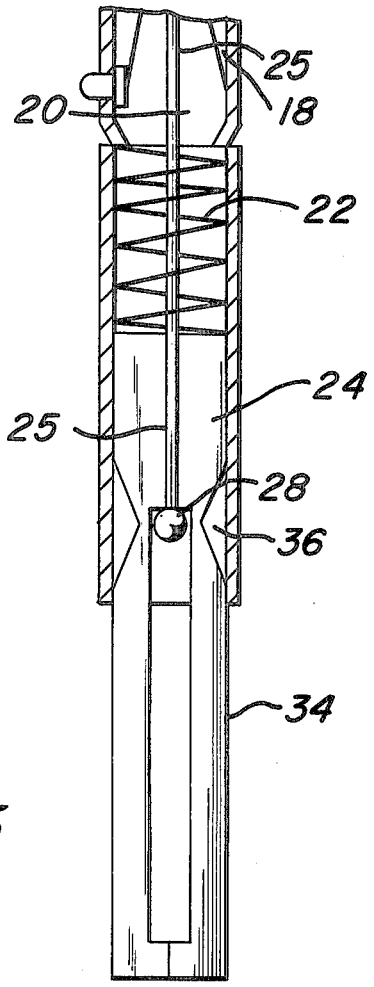
FIG. 5 is a cross-sectional, schematic view of the fingers of the hinge as they are withdrawn within the outer shaft to achieve the condition of FIG. 1.

Turning now to FIG. 5, it is noted that disposed at the lower portion of the inner shaft 18 is a triangular block-like element 20 which serves as the support for a tension spring 22 which, at the opposite end thereof, urges against the base of a hinge 24. Axially located within said element 20, said spring 22, and said hinge 24, is an axial wire-like member 25 which passes through the entire length of the present device, beginning at trigger 26 and terminating in a ball-shaped element 28. The trigger 26 is rotatable in a direction transverse to the plane of the illustrations of FIGS. 1 through 5 and, through such rotation, accomplishes a reciprocal movement of said axial member 25 and its associated ball element 28.

Further, it is to be noted that the present device, in functioning as a walking cane, is adjustable as to length through a relative adjustment of the transverse position of the outer shaft 16 with respect to the inner shaft 18. Such adjustment is achieved through an appropriate placement of protruding element 30, which is anchored to the triangular base 20, into an appropriate one of a plurality of slots 32 so as to attain a desired total length of the cane in order to accommodate different users within a considerable range of heights.

Figure 2:
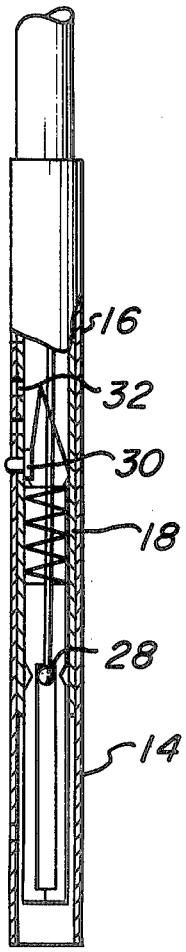
FIG. 2 is a cross-sectional schematic view illustrating the outer tubular shaft in a retracted position with respect to the inner shaft, thus permitting the fingers of the hinge to occupy their normally-open position.
Figure 2:
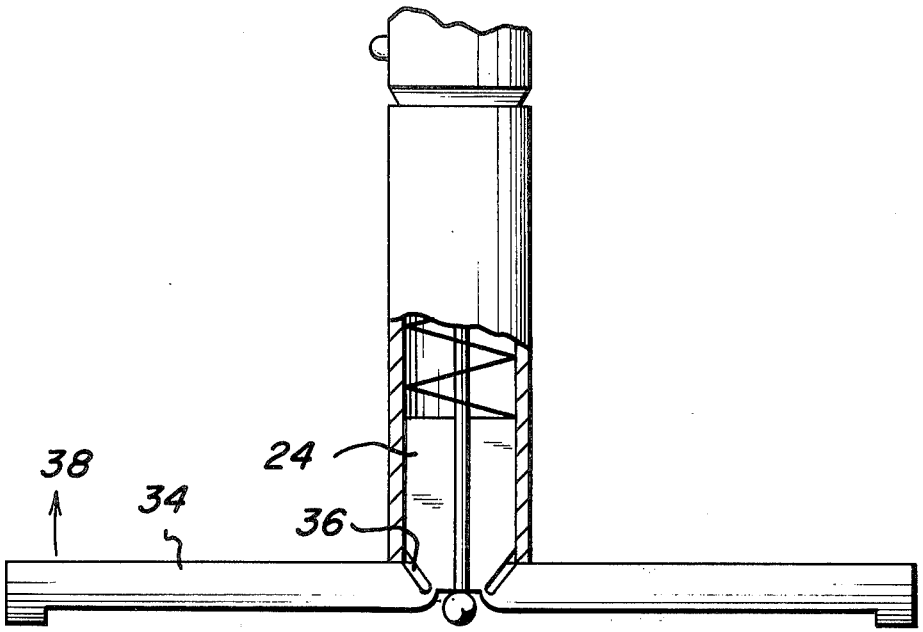
Figure 3:
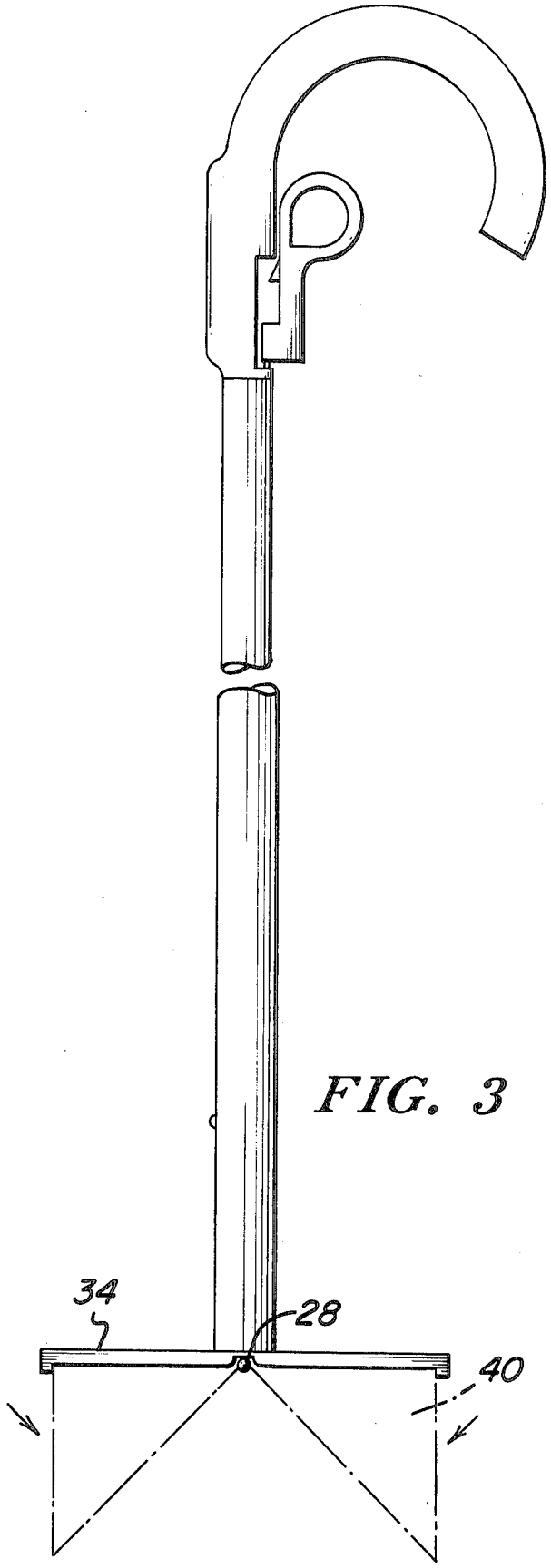
FIG. 3 is a schematic perspective view similar to FIG. 2, however, showing the disposable box affixed to the fingers of the hinge.

Turning now to FIG. 2, it is noted that the hinge 24 is opened to a position in which its fingers 34 open in order to form an angle of about 180 degrees. Said angle is achievable in part by virtue of the openings 36 which separate the base area of the hinge from its fingers 34. Further, however, the normally-open condition of the fingers as shown in FIG. 2, is obtained by virtue of a molding of polypropylene, or other similar material, in the configuration shown in FIG. 2. Once molded in such a form, the material will retain what is termed a "natural memory" and, by virtue thereof, will continuously attempt to gain the configuration of FIG. 2. That is, if the fingers 34 are pressed together, the natural memory will exert a force in direction 38 in order to angularly oppose any force attempting to close said fingers 34.

Turning now to the steps involved in utilizing the present device. In order to change the device from its walking cane condition of FIG. 1 to the "box attachment" position of FIG. 2, the outer tubing 16 is pulled upward in the direction of the handle 12, thereby permitting fingers 34 to pop upward into their natural position.

At this point, the user will take the box 40 out of his pocket, will unfold it, and will then press its centrally disposed opening 42 (see FIG. 6) against ball element 28 while pressing corners 44 into the inside of the fingers 34. This is done while the apparatus is held in a generally vertical position.

In order to begin the pickup procedure, the trigger 26 is turned into an upward position thereby pulling axial member 25 and causing fingers 34 to close the box 40 in the manner shown in FIG. 4. The trigger is slowly and continually pulled upward until the box is closed and a complete acquisition of the animal deposit is achieved. The closed box, in combination with the device, is then carried to a waste disposal area at which time the trigger is then unlocked and rotated further upward, thus causing a retraction of the ball element 28 which will tear through the opening 42. The fingers are then opened, causing the disposable box to drop into the waste disposal area.

Following the above step, the hinge, shown in FIG. 5, is again withdrawn into the outer cylinder.

Figure 6:
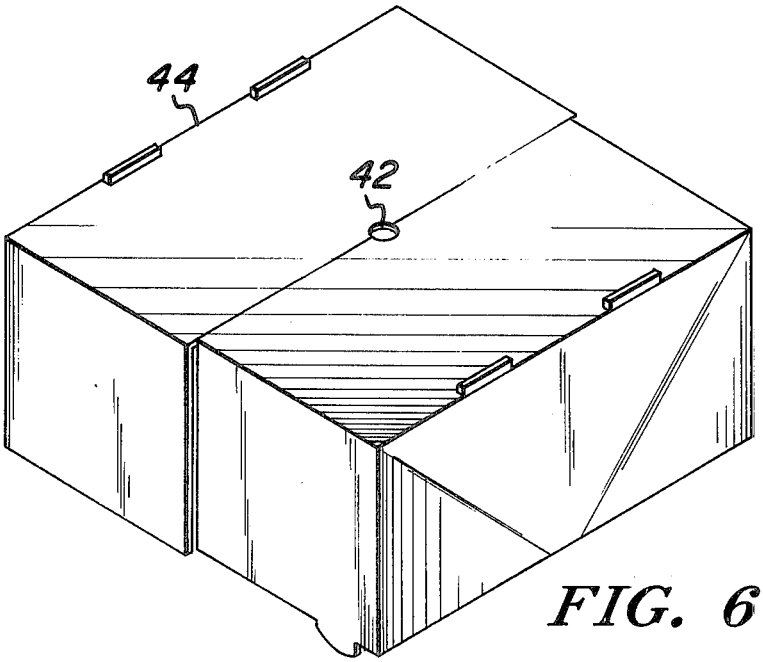
FIG. 6 is a schematic perspective view of a first embodiment of a disposable box which may be utilized in association with the present device.

Shown in FIG. 6 is one embodiment of a foldable pickup box which may be utilized in association with the present device. Shown in FIG. 7 is a second such embodiment. This embodiment illustrates a pop-open aspect of said embodiment.

It is to be appreciated that the above-described device provides the user not only with an effective walking cane but also with a simple and readily disposable throwaway container which is easily utilized in combination with the device of the present invention, thereby effectively solving the prior art problems set forth in the Background of the Invention.

While there have been herein shown and described the preferred embodiments of the present invention, it will be understood that the invention may be embodied otherwise than as herein specifically illustrated or described and that within said embodiments, certain changes in the detail and construction, and the form of arrangement of the parts may be made without departing from the underlying idea or principles of this invention within the scope of the appended claims.

What is claimed is:

1. An apparatus for retrieving waste material comprising:

a. an outer tubular shaft having at one end thereof a U-shaped handle end and at the opposite end thereof a distal end;

b. an inner tubular shaft telescopically associated within said outer shaft at said distal end thereof;

c. a hinged grasping member comprising a unitary base secured at one end thereof within the distal end of said inner shaft and at the other end thereof defining finger elements extending in their natural state in opposite directions to each other, said grasping member prepared from a resilient, flexible material, said finger elements adapted to flex toward each other to grasp and secure an open disposable litter receptacle during the placement of litter therein and to subsequently effect the closing of said receptacle;

d. a trigger element rotatably secured to said handle end;

e. a connecting wire attached to said trigger and passing axially through the length of said outer shaft and said inner shaft, respectively, said connecting wire passing through an opening provided in said base and terminating between said fingers, said wire having its degree of tension controlled by the movement of said trigger element;

f. a ball element attached to said wire at its point of termination and emergence from said base, said ball element serving to pass through a corresponding opening in said litter receptacle to secure said receptacle in position between said fingers during the placement of said litter therewithin; and g. a biasing element disposed about said wire and abuttingly disposed to said base, said biasing element serving to accomplish a fine control of the closing of said fingers by said trigger, whereby longitudinal movement of said outer shaft toward said handle end will cause the release of said fingers into a naturally open opposed disposition for cooperation with said ball element to associate with an open, unused waste receptacle.

2. The apparatus as recited in claim 1 in which said handle end is formed in the shape of the handle of a walking cane.

3. The apparatus as recited in claim 2 in which said outer tubular shaft includes means for insertion into any one of a plurality of transverse positions with respect to said inner tubular shaft in order to thusly obtain a total length of the present apparatus suitable, in use as a walking cane, to users of varying heights.

4. The apparatus as recited in claim 1 in combination with a foldable throwaway box adapted for insertion within the fingers of said hinges.

5. The apparatus as recited in claim 1 in which said hinge is molded in a normally open position so as to create a "natural memory" of the fingers thereof into such a normally open position.

* * * * *